US006884449B2

(12) United States Patent
Lee et al.

(10) Patent No.: US 6,884,449 B2
(45) Date of Patent: Apr. 26, 2005

(54) MICROWAVE OVEN HAVING RICE COOKING FUNCTION AND METHOD OF CONTROLLING THE SAME

(75) Inventors: Sung-ho Lee, Suwon (KR); Young-won Cho, Suwon (KR); Tae-soo Kim, Seoul (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 221 days.

(21) Appl. No.: 10/060,202

(22) Filed: Feb. 1, 2002

(65) Prior Publication Data

US 2003/0031766 A1 Feb. 13, 2003

(30) Foreign Application Priority Data

Aug. 7, 2001 (KR) ..... 10-2001-0047528

(51) Int. Cl.[7] ..... H05B 6/00

(52) U.S. Cl. ..... 426/233; 99/451; 219/678; 219/702; 219/707; 426/243

(58) Field of Search ..... 426/231, 233, 426/241, 243; 219/678, 702, 704, 707; 99/451

(56) References Cited

U.S. PATENT DOCUMENTS

| | | | | |
|---|---|---|---|---|
| 4,853,509 A | * | 8/1989 | Murakami | 219/731 |
| 5,360,965 A | * | 11/1994 | Ishii et al. | 219/705 |

FOREIGN PATENT DOCUMENTS

| | | |
|---|---|---|
| EP | 0 305 105 | 3/1989 |
| EP | 0 306 655 | 3/1989 |
| GB | 2 255 205 | 10/1992 |
| JP | 58-13935 | 1/1983 |
| JP | 2-20296 | 2/1990 |
| JP | 4-90420 | 3/1992 |
| JP | 4-369320 | 12/1992 |
| JP | 5-123251 | 5/1993 |
| JP | 5-223256 | 8/1993 |
| JP | 7-184767 | 7/1995 |
| JP | 10-148337 | 6/1998 |
| JP | 11-83023 | 3/1999 |
| KR | 1990-3965 | 6/1990 |
| KR | 1990-3967 | 6/1990 |
| KR | 1993-6177 | 7/1993 |
| KR | 1993-10264 | 10/1993 |
| KR | 1994-4979 | 6/1994 |
| KR | 1995-5747 | 5/1995 |
| KR | 1999-58206 | 7/1999 |
| KR | 2000-31057 | 6/2000 |
| KR | 10-275889 | 9/2000 |

OTHER PUBLICATIONS

English translation of Japanese Publication No. 5–223256.*
English translation of Japanese Publication No. 4–90420.*
English translation of Japanese Publication No. 2–20296.*
English translation of Japanese Publication No. 7–184767.*

* cited by examiner

*Primary Examiner*—George C. Yeung
(74) *Attorney, Agent, or Firm*—Staas & Halsey LLP

(57) ABSTRACT

A method for controlling a rice cooking operation in a microwave oven including setting up at least one rice cooking operation in the microwave oven based upon the amount of rice and water mixture; heating the rice and the water in a cooking chamber using a magnetron; computing the amount of the rice and the water by measuring a vapor concentration within the cooking chamber; and cooking the rice according to a cooking operation corresponding to the computed amount of rice and water. Further, the present invention provides a microwave oven having at least one rice cooking operation and a method of controlling the same, in which rice is cooked by automatically sensing the amount of rice and water content using the method.

11 Claims, 5 Drawing Sheets

MICROWAVE OVEN HAVING RICE COOKING FUNCTION AND METHOD OF CONTROLLING THE SAME

CROSS-REFERENCE TO RELATED APPLICATIONS

This application claims the benefit of Korean Patent Application No. 2001-47528 filed on Aug. 7, 2001, in the Korean Industrial Property Office, the disclosure of which is incorporated herein by reference.

BACKGROUND OF THE INVENTION

1. Field of the Invention

The present invention relates in general to a microwave oven having at least one rice cooking operation and a method of controlling the same, and more particularly, to a microwave oven having at least one rice cooking operation and a method of controlling the same in which rice is cooked by automatically sensing the amount of rice and water content.

2. Description of the Related Art

A microwave oven cooks food using high frequency electromagnetic waves generated from a magnetron. Accordingly, as the operations to cook food have become more varied, a microwave oven having a rice cooking operation has been developed. In such a microwave oven, rice cooking is generally performed as follows. First, a user fills a bowl with a predetermined amount of rice and water and sets up data on these predetermined amounts through a key input unit. Then, the rice cooking is executed according to a program stored in a memory of a microcomputer. The program controls an output level and heating time of the magnetron according to the amount of rice and water mixture. Thus, by controlling the output level and heating time of the magnetron, the microwave oven cooks rice according to different processes including allowing rice to absorb water, to be boiled, and to be steamed.

However, the conventional microwave oven requires setting up information related to the amount of rice and water manually, thereby making the process inconvenient to a user.

SUMMARY OF THE INVENTION

Accordingly, to overcome the above and other problems, it is an object of the present invention to provide a microwave oven having at least one rice cooking operation and a method of controlling the same in which rice is cooked by automatically sensing the amount of rice and water content.

Additional objects and advantages of the invention will be set forth in part in the description which follows and, in part, will be obvious from the description, or may be learned by practice of the invention.

The foregoing and other objects of the present invention may be achieved by providing a method of controlling rice cooking operations in a microwave oven, the method comprising: setting up at least one rice cooking operation in the microwave oven depending upon the amount of rice and water; heating rice and water in a cooking chamber using a magnetron; computing the amount of rice and water by measuring a vapor concentration within the cooking chamber; and cooking the rice corresponding to the computed amount of rice and water.

The above and other objects of the present invention may further be achieved by providing that an output level of the magnetron is set up corresponding to the type of rice and the amount of a mixture including rice and water, and other ingredients if applicable.

The above and other objects of the present invention may still further be achieved by providing that an operating time of the magnetron is set up corresponding to the type of rice and the amount of a mixture of rice and water, and other ingredients if applicable.

The above and other objects of the present invention may still further be accomplished by providing that the cooking of the rice comprises: allowing rice to absorb water; boiling the rice; and steaming the rice at a predetermined temperature.

The above and other objects of the present invention may still further be accomplished by providing that the boiling of the rice comprises: detecting the vapor concentration within the cooking chamber; and lowering the output of the magnetron when the sensed vapor concentration reaches a predetermined value.

The above and other objects of the present invention may still further be accomplished by providing that the predetermined value is set as a value at a point of time when the water reaches a boiling point thereof.

The foregoing and other objects of the present invention may be also achieved by providing a microwave oven having at least one rice cooking operation comprising a control panel through which a user can select at least one rice cooking operation, a magnetron to heat a mixture including rice and water with high frequency electromagnetic waves, a gas sensor to sense a vapor concentration generated from the mixture, a memory to store at least one rice cooking operation corresponding to an amount of the mixture of rice and water, and a controller to drive the magnetron to heat the mixture, to compute the amount of the mixture depending upon the sensed vapor concentration detected by the gas sensor, and to read one of the at least one rice cooking operations corresponding to the amount of the mixture which are stored in the memory in order to control the magnetron.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
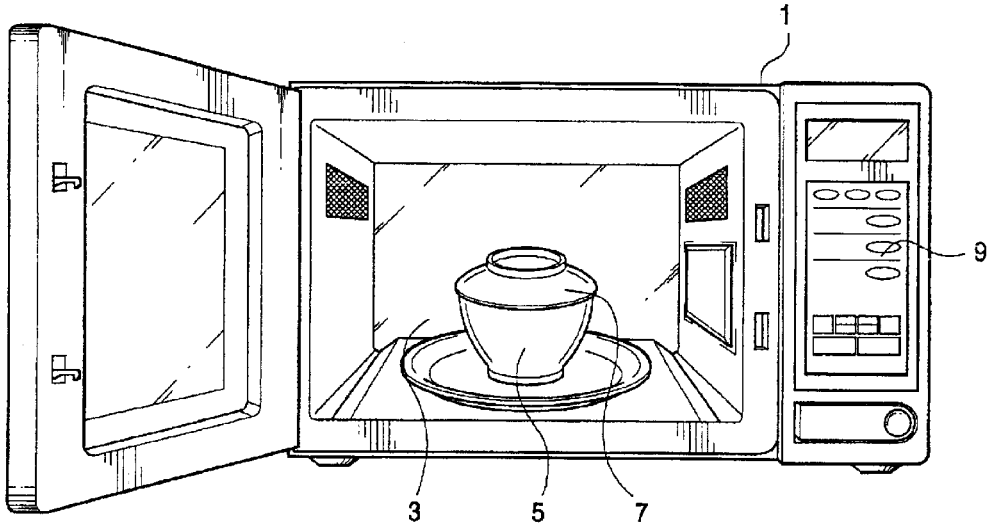
FIG. 1 is perspective view of a microwave oven and a bowl for cooking rice according to an embodiment of the invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIG. 1, a microwave oven 1 comprises a cooking chamber 3 in which food is cooked, and a control panel 9 provided outside the cooking chamber 3 to select a cooking operation to be performed. To cook rice using the microwave oven 1, a bowl 5 is filled with rice and water, and a lid 7 is used to cover the bowl 5. The bowl 5 is made of materials such as ceramic, etc., that are not influenced by high frequency electromagnetic waves as to be usable in a microwave oven 1. However, a household bowl made of ceramic may be used as an alternative. The lid 7 is used to prevent water from steaming away when rice and water in the bowl 5 are cooked together, and also keeps the temperature and pressure of the rice at a level such that it is well boiled. However, plastic wraps and other flexible coverings can be used instead of or in addition to the lid 7.

Accordingly, a user fills the bowl 5 with rice and water and covers it with the lid 7 in order to thereby boil the rice and water using the microwave oven 1. Further, while not shown, it is possible to simultaneously boil a plurality of the bowls 5 of rice and water depending on the number of servings of rice desired.

Figure 2:
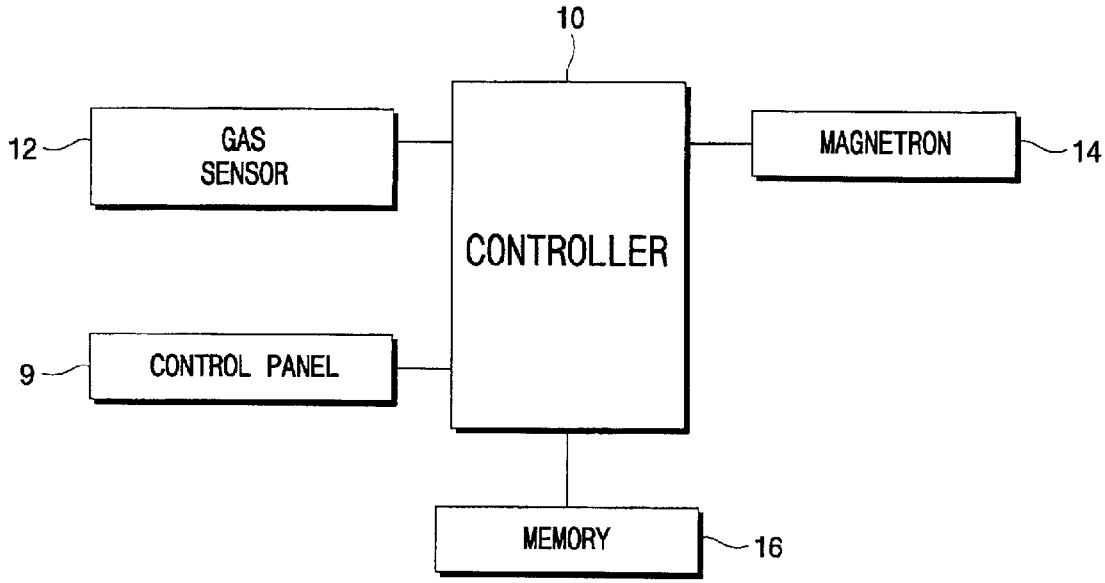
FIG. 2 is a control block diagram of a microwave oven according to another embodiment the present invention having a rice cooking function.

As shown in FIG. 2, the microwave oven 1 according to an aspect of the present invention comprises the control panel 9 to select the cooking operation, a magnetron 14 to heat the food with high frequency electromagnetic waves, a gas sensor 12 to sense moisture (i.e., vapor) generated from food placed in the microwave, a memory 16 to store therein rice cooking operations according to the amount of rice and water, and a controller 10 to control the magnetron 14 to cook rice by detecting the amount of rice and water based upon the concentration of vapor in the air detected by the gas sensor 12, corresponding to the cooking operation selected by a user through the control panel 9.

The control panel 9 comprises a plurality of selection keys, and further comprises an automatic rice cooking key for the rice cooking operation.

The memory 16 stores therein cooking data by which rice is cooked according to the number of servings of rice. The cooking data is a cooking program that controls an output level and operating time of the magnetron 14 according to the amount of rice and water. Thus, according to the cooking data, the controller 10 controls the output level and operating time of the magnetron 14 to heat rice so as to make the rice absorb the water, to boil the rice for a predetermined period of time, and to steam the rice to completion. Further, the memory 16 stores therein cooking data according to not only the number of servings desired, but also the type of rice to be cooked. For instance, the type of rice could be cereals-mixed rice, bean-mixed rice, etc.

The gas sensor 12 senses the vapor concentration within the cooking chamber 3. That is, if the bowl 5 is filled with rice and water and is heated in the cooking chamber 3 to generate vapor from the water, the gas sensor 12 detects the vapor concentration and transmits it to the controller 10. The controller 10 drives the magnetron 14 to heat the bowl 5 filled with rice and water when the automatic rice cooking operation is selected. If the vapor concentration detected by the gas sensor 12 reaches a predetermined value, the controller 10 calculates the amount of rice and water on the basis of the period of time from which the magnetron 14 begins operating until the vapor concentration reaches the predetermined value. If there are a plurality of bowls 5 in the microwave oven 1, the time it takes to cook the rice is proportional to the number of the bowls 5. Accordingly, the controller 10 computes the number of bowls 5 on the basis of the time from which the magnetron 14 begins operating until the vapor concentration reaches the predetermined value.

Consequently, if the number of bowls 5 is determined depending upon the vapor concentration detected by the gas sensor 12, the controller 10 cooks the rice according to a predetermined heating time and output level of the magnetron 14 corresponding to the number of bowls 5 detected by the gas sensor 12.

Figure 3:
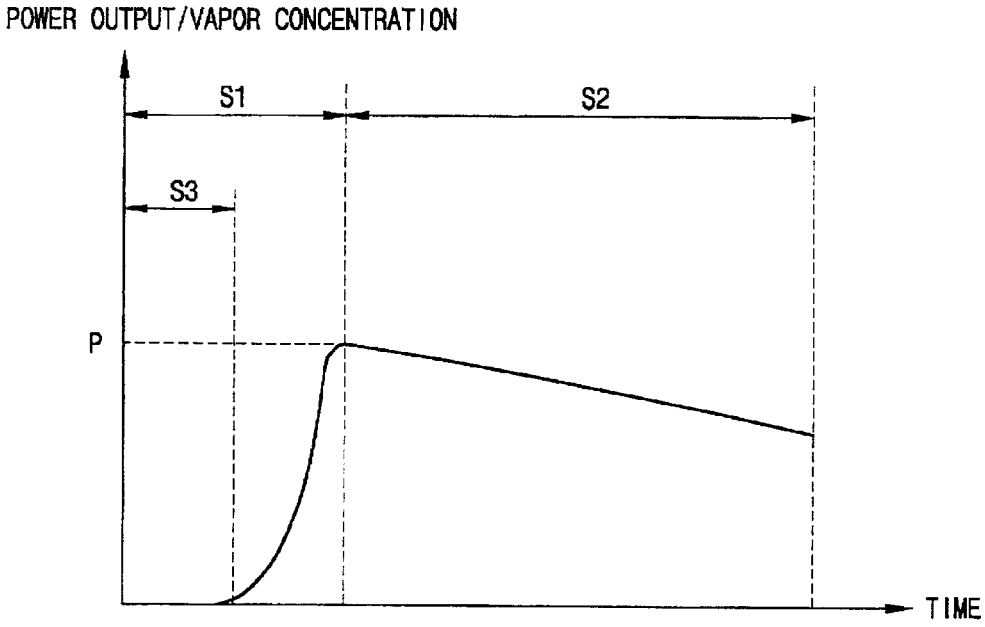
FIG. 3 is a graph illustrating the relationship between an output of a magnetron and the concentration of vapor in air when rice is cooked.
Figure 4:
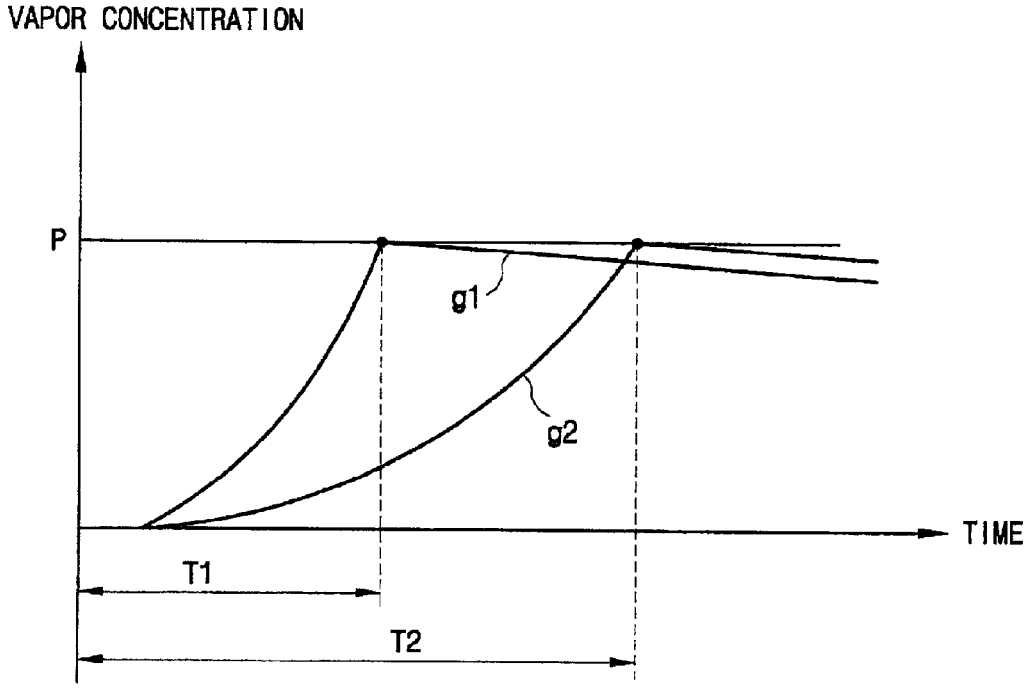
FIG. 4 is a graph showing the relationship between the amount of rice and the concentration of vapor in air.

Referring to FIGS. 3 and 4, an operation in which the controller 10 determines the number of bowls 5 in the cooking chamber 3 will be described. FIG. 3 is a graph illustrating the relationship between an output of the magnetron 14 and the concentration of vapor in the air when the rice is being cooked. If a user puts the bowl 5 filled with rice and water in the cooking chamber 3 and selects the automatic rice cooking function through the control panel 9, the rice cooking is started. As shown therein, during a period S1 in which the rice is cooking, the rice and water mixture within the bowl 5 is heated by a maximum output level of the magnetron 14 so as to be well boiled. After the heating period of S1 is a period S2, during which the output of the magnetron 14 is lowered so as to steam the boiled rice.

The vapor within the cooking chamber 3 is not generated during an initial heating period S3 of the rice as it is cooking, but the vapor concentration begins to increase as the rice and water mixture is boiled. The gas sensor 12 detects the vapor concentration as it increases, and transmits the detected values to the controller 10. If the vapor concentration detected by the gas sensor 12 reaches a predetermined value (P), the controller 10 measures the time (S1) taken for this vapor concentration to reach the predetermined value (P) from the time at which the magnetron 14 begins heating. Herein, it is desirable that the predetermined value (P) is set as a value at a point of time when water comes to the boiling point. Alternatively, the predetermined value (P) may be set as a value at any point of time. Further, where the another liquid is chosen, the predetermined value may be the boiling point of that liquid.

Thus, the controller 10 determines the number of bowls based on the time it takes the vapor concentration to reach the predetermined value (P) to thereby control the output level and heating time of the magnetron 14.

FIG. 4 is a graph illustrating the relationship between the amount of rice and the vapor concentration. As illustrated in FIG. 4, the generating line of the vapor concentration varies according to the number of bowls in the cooking chamber 3. In the graph of FIG. 4, "g1" indicates a vapor concentration generated when one bowl of rice and water is being cooked, and "g2" indicates a vapor concentration generated when two bowls of rice and water are being cooked. As illustrated in the graph, the vapor concentration in the case of two bowls 5 rises more slowly than one bowl 5 since the time necessary to heat the water is prolonged in proportion to the amount of rice and water.

Thus, in the case of providing two bowls 5, the time (T2) until the concentration line g2 reaches the predetermined value (P) is twice as long as the time (T1) until the concentration line g1 reaches the predetermined value (P). Using the difference between the time (T1) and (T2), the controller 10 of the microwave oven 1 according to the present invention computes the amount of rice and water so that the rice cooking can be automatically executed regardless of the amount of rice and water placed in the microwave 1.

Figure 5:
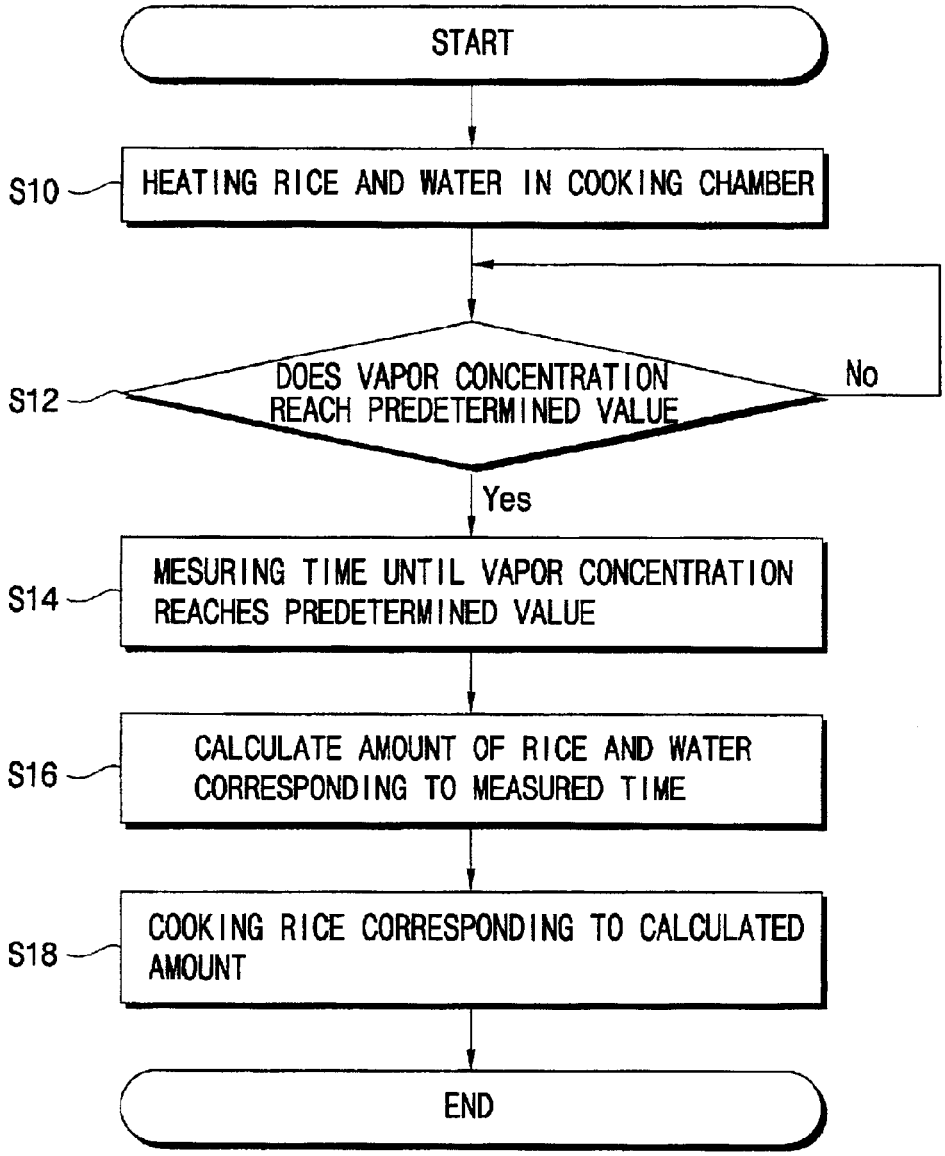
FIG. 5 is a control flow chart of the microwave oven according to an embodiment of the present invention having a rice cooking operation.

With the configuration of FIG. 4, and referring to FIG. 5, a control flow diagram of the microwave oven 1 having the rice cooking operation will be described hereinbelow.

First, if a user puts a number of bowls 5 in the microwave 1 after filling the bowls 5 with rice and water as desired, and selects the rice cooking operation through the control panel 9, the controller 10 drives the magnetron 14 to heat the rice and water in the cooking chamber 3 (S10). Then, the gas sensor 12 senses the vapor concentration within the cooking chamber 3 and transmits the vapor concentration to the controller 10, wherein the controller 10 then determines whether the vapor concentration has reached the predetermined value (P) (S12). In accordance with the vapor concentration detected by the gas sensor 12, if the vapor concentration is determined to have reached the predetermined value (P), the controller 10 measures the time (S1) taken for the vapor concentration to reach the predetermined value (P) from the time at which the magnetron begins heating the rice and water (S14). That is, the controller 10 measures the period of time after the magnetron 14 begins operating until the vapor concentration within the cooking chamber 3 reaches the predetermined value (P). On the basis of this measured period of time, the controller 10 computes the number of bowls 5 (S16). Lastly, the controller 10 controls the heating time and an output level of the magnetron 14 by reading a rice cooking operation corresponding to the computed number of bowls 5 from the memory 16, thereby cooking the rice (S18).

In the above embodiment, the microwave oven 1 comprises the operations of boiling and steaming rice according to the amount of rice and water. However, the microwave oven 1 may further comprise the operation of making the rice absorb water. This is achieved by having the controller 10 lower the output of the magnetron 14 according to the amount of rice and water so as to allow rice to absorb the water.

As described above, according to the present invention, the vapor concentration is sensed in the microwave cooking chamber, and the amount of rice and water is computed on the basis of the time it takes for the sensed vapor concentration to reach a predetermined value from the time at which the magnetron 14 begins heating. Then, rice is automatically cooked according to the amount of rice and water computed to be in the microwave cooking chamber so that a user need not set up separate operations manually according to the amount of rice and water to be cooked. Further, while described in terms of bowls 5, it is understood that a same bowl 5 can contain numerous servings without requiring separate containers. Further, it is understood that a similar operation could be performed with other combinations of liquid and rice/cereal, such as cooking oatmeal, cream of wheat or other similar items.

As described above, the present invention provides a microwave oven having at least one rice cooking operation and a method of controlling the same, in which rice is cooked by automatically sensing the amount of rice and water.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling cooking rice in a microwave oven, the method comprising:

setting up at least one rice cooking operation in the microwave oven depending upon an amount of rice and water;

heating the rice and the water in a cooking chamber of the microwave oven using a magnetron;

computing the amount of the rice and the water in the microwave oven by measuring a vapor concentration within the cooking chamber; and cooking the rice using the at least one rice cooking operation corresponding to the computed amount of the rice and the water.

2. The method according to claim 1, wherein said setting up the at least one rice cooking operation comprises providing data as to an output level of the magnetron to be controlled corresponding to the type of rice and the ratio of the rice to the water.

3. The method according to claim 1, wherein said setting up the at least one rice cooking operation comprises providing data relating to an operating time of the magnetron corresponding to the type of rice and the ratio of the rice to the water.

4. The method according to claim 1, wherein said cooking the rice comprises, according to the at least one rice operation, allowing the rice to absorb water;

boiling the rice; and steaming the rice at a predetermined temperature.

5. The method according to claim 4, wherein the boiling of the rice comprises:

detecting the vapor concentration within the cooking chamber; and lowering an output of the magnetron when the sensed vapor concentration reaches a predetermined value.

6. The method according to claim 5, wherein the predetermined value corresponds to a boiling point of the water.

7. A microwave oven comprising:

a control panel through which a user can select at least one rice cooking operation;

a magnetron to heat a mixture of rice and water in the microwave oven with high frequency electromagnetic waves;

a gas sensor to sense a vapor concentration generated from the mixture being cooked;

a memory to store at least one rice cooking operation according to an amount of a mixture of the rice and the water be heated; and a controller to drive said magnetron to heat the mixture, to compute the amount of the mixture depending upon the sensed vapor concentration detected by said gas sensor, and to read the at least one rice cooking operation from said memory to control said magnetron.

8. The microwave oven according to claim 7, wherein said controller controls an output level of said magnetron based on the computed amount of the mixture.

9. The microwave oven according to claim 7, wherein the controller controls an operating time of said magnetron based on the computed amount of the mixture.

10. The microwave oven according to claim 7, wherein said controller controls an output level of said magnetron to be lowered when the sensed vapor concentration sensed by said gas sensor reaches a predetermined value.

11. The microwave oven according to claim 10, wherein the predetermined value is set as a value at a point of time when the water is heated to the boiling point of water.

* * * * *